US010527046B2

(12) United States Patent
Niemiec et al.

(10) Patent No.: US 10,527,046 B2
(45) **Date of Patent: *Jan. 7, 2020**

(54) STEPPED-LOUVRE HEATING, VENTILATING AND AIR CONDITIONING UNIT USED IN HIGH VOLUME, LOW-SPEED FAN

(71) Applicants: Darrin Walter Niemiec, Schaumburg, IL (US); James C. Muth, Schaumburg, IL (US); Patrick Todd Woodzick, Schaumburg, IL (US); William J. Carlson, Schaumburg, IL (US); Jeffrey William Buske, Schaumburg, IL (US)

(72) Inventors: Darrin Walter Niemiec, Schaumburg, IL (US); James C. Muth, Schaumburg, IL (US); Patrick Todd Woodzick, Schaumburg, IL (US); William J. Carlson, Schaumburg, IL (US); Jeffrey William Buske, Schaumburg, IL (US)

(73) Assignee: WLC Enterprises, Inc., Schaumburg, IL (US)

( * ) Notice: Subject to any disclaimer, the term of this patent is extended or adjusted under 35 U.S.C. 154(b) by 366 days.

This patent is subject to a terminal disclaimer.

(21) Appl. No.: 15/346,913

(22) Filed: Nov. 9, 2016

(65) Prior Publication Data

US 2017/0114789 A1 Apr. 27, 2017

Related U.S. Application Data

(63) Continuation-in-part of application No. 15/043,923, filed on Feb. 15, 2016, and a continuation-in-part of application No. 14/814,161, filed on Jul. 30, 2015.

(51) Int. Cl.

| | |
|---|---|
| ***F04D 25/08*** | (2006.01) |
| ***F04D 29/52*** | (2006.01) |
| ***F04D 29/38*** | (2006.01) |

(52) U.S. Cl.
CPC ..... *F04D 25/088* (2013.01); *F04D 29/384* (2013.01); *F04D 29/522* (2013.01)

(58) Field of Classification Search
CPC .... F04D 25/088; F04D 29/384; F04D 29/281; F24F 13/06; F24F 13/075; F24F 13/082;
(Continued)

(56) References Cited

U.S. PATENT DOCUMENTS 6,458,028 B2 * 10/2002 Snyder ..... F04D 25/088 454/292
2007/0154315 A1 7/2007 Bucher

FOREIGN PATENT DOCUMENTS

JP 2006009699 A 1/2006
WO WO-9844299 A1 * 10/1998 ..... F24F 1/56
WO WO2014026246 A1 2/2014

OTHER PUBLICATIONS

WO 9844299 Specification English Translation, Espacenet (Year: 1998).*

(Continued)

*Primary Examiner* — Jason D Shanske
*Assistant Examiner* — John S Hunter, Jr.
(74) *Attorney, Agent, or Firm* — Vitale, Vickrey, Niro & Gasey LLP

(57) ABSTRACT

A manifold including a stepped louvre to control airflow along a fan blade. A fan blade for use in a high volume, low-speed fan, wherein the fan blade includes a body portion, a leading edge portion and a trailing portion. The leading edge portion of the fan blade includes a series of steps extending along the length of the leading edge. The fan distributes airflow from the manifold.

4 Claims, 17 Drawing Sheets

(58) Field of Classification Search
CPC ..... F24F 13/10; F24F 13/14; F24F 13/1413; F24F 13/1473; F24F 13/15; F24F 2001/0062; F24F 2013/0608
See application file for complete search history.

(56) References Cited

OTHER PUBLICATIONS

All Out Cool, Outdoor Fan: Blades, Refereed to as "AOC" in office action, Dated Feb. 12, 2011 (Year: 2011).*
European Search Report and Written Opinion dated Dec. 5, 2016.

* cited by examiner 465
469
430
400
420
460
412
410
432

467
468
465
400
410
420
469
460
412

440
420

STEPPED-LOUVRE HEATING, VENTILATING AND AIR CONDITIONING UNIT USED IN HIGH VOLUME, LOW-SPEED FAN

This application is a Continuation-In-Part of U.S. application Ser. No. 15/043,923 filed Feb. 15, 2016 which is a Continuation-In-Part of U.S. application Ser. No. 14/814,161, filed Jul. 30, 2015; the '923 and the '161 applications are now pending and incorporated by reference herein.

FIELD OF THE INVENTION

The present invention relates generally to the design of a heating, ventilating and air conditioning unit used in conjunction with high volume, low-speed fans. More particularly, the present invention pertains to the design of an apparatus to deliver chilled or heated air through stepped louvres of a manifold to the blades of a fan in which the leading edge has regular steps at a predetermined ratio configured to create turbulent airflow.

BACKGROUND OF THE INVENTION

The indoor environment is a significant concern in designing and building various structures. Human and occupant comfort are largely affected by airflow, thermal comfort and relevant temperature. Airflow is generally the measurable movement of air across a surface. Relevant temperature is the degree of thermal discomfort measured by airflow and temperature. Airflow that improves an employee health and productivity can have a large return on investment. High volume, low-speed ceiling and vertical fans can provide significant energy savings and improve occupant comfort in large commercial, industrial, agricultural and institutional structures. High volume low-speed (HVLS) fans are the newest ventilation option available today. These large fans, which range in size from 8 to 24 feet, provide energy-efficient air movement throughout a large volume building at a fraction of the energy cost of high-speed fans.

The main advantage of an HVLS fan is its limited energy consumption. One 20-foot fan typically moves approximately 125,000 cubic feet per minute (cfm) of air. It takes six to seven standard fans to provide similar volume of air movement. An eight-foot fan can move approximately 42,000 cfm of air. Most HVLS fans employ a 1 to 2 HP motor, moving the same volume of air (for approximately one-third of the energy cost) of six high-speed fans.

HVLS fans move large columns of air at a slow velocity, about 3 mph (260 fpm). Air movement of as little as 2 mph (180 fpm) has been shown to provide a cooling effect on the human body according to the Manual of Naval Preventive Medicine. In fact, airflow at 2 mph will give a cooling effect of approximately 5° F. (the air feels 5° F. cooler) and an airflow of 4 mph will provide a cooling effect of approximately 10° F.; that is, if the actual temperature was 75° F. with an airflow of 4 mph, the relative temperature would be 65°. The cooling effect is described as the relative temperature. Moreover, it has been shown that turbulent airflow provides a more-effective cooling sensation than uniform airflow by David W. Kammel, et al., "Design of High Volume Low Speed Fan Supplemental Cooling System in Free Stall Barns."

A study done by the University of Wisconsin shows that HVLS systems provide more widespread air movement throughout the building or space to be cooled. One disadvantage of traditional HVLS fans is that they have an area of "dead" air (air that has minimal air movement) in close proximity to the centerline of the fan.

Although high-speed fans provide more velocity, each unit impacts only a small, focused area. High-speed fans are good for managing extreme heat, although they can cause a dramatic increase in energy consumption in the hot, summer months. High-speed fans produce higher velocities in the area directly surrounding each fan, leaving large areas of dead air outside the diameter of the fan blades.

HVLS systems are sometimes used year-round. In summer, HVLS fans provide essential cooling; in winter, the fans move warmer air from ceiling to floor level and may result in a more comfortable environment. HVLS fans are virtually noiseless. HVLS fans provide more comfort to individuals positioned in proximity to the fan, because the airflow causes a lower relevant temperature—that is, the air temperature feels cooler because of the movement of the air. The optimal airflow velocity for HVLS fans is typically between 2 to 4 miles per hour for most operations. Spacing the fans too far apart will significantly diminish the system's benefits.

HVLS fans cost approximately $4,200-$5,000 each, including installation. While this is a large upfront investment, facility must use six to seven high-speed fans at $200-$300 each to move the same volume of air as with one HVLS fan. Energy savings realized through the use of HVLS fans over a high-speed fan system should make up the cost difference within two to three years. Manufacturers claim that HVLS fans typically do not require replacement for at least 10 years. Because high-speed fans operate a higher RPM, the motors typically need to be replaced more frequently than with HVLS fans.

The components of a typical fan include:

An electromagnetic motor;

Blades also known as paddles or wings (usually made from wood, plywood, iron, aluminum or plastic);

Metal arms, called blade mounts (alternately blade brackets, blade arms, blade holders, or flanges), which hold the blades and connect them to the motor;

A mechanism for mounting the fan to the ceiling.

There are axial flow fan blades available in the prior art that address the issue of increasing the efficiency of a fan. For example, U.S. Pat. Nos. 4,089,618, 5,603,607 and 5,275,535 all pertain to fan blades in which the trailing edges contain notches or a saw-tooth shape. Additionally, in U.S. Pat. No. 5,275,535, both the leading and the trailing edges are notched. Moreover, U.S. Pat. Nos. 5,326,225 and 5,624,234 disclose fan blade platform shapes that are curved forward and backward. Despite the fact that the referred patents may present a reduction on the noise level and an increase on the efficiency, the improvement obtained is quite modest. Consequently, the applicability of these patents is limited in actual practice. Another prior art technology, as depicted in U.S. Pat. No. 8,535,008, utilizes a leading edge which includes a series of spaced "tubercles" formed along the leading edge of the rotor blade.

None of the prior art shows a stepped-louvre configuration in an air handling manifold or diffuser nor do the patents depict a stepped-fan blade. There is a need for a stepped-louvre configuration in an air handling manifold to create turbulent airflow and deliver an increased velocity over a greater volume. The stepped-louvre configuration in an air handling manifold may be used in connection with a high volume, low-speed fan having a stepped blade configuration to create turbulent airflow and deliver an increased volume of either cooled or heated air to create a more comfortable environment.

SUMMARY OF THE INVENTION

It has been determined that turbulent airflow is more effective at providing a cooling sensation than uniform airflow. The present invention incorporates a stepped design on the leading edge of the fan blade. The leading edge of the fan blade is stepped such that the widest portion of the blade is located closest to the hub of the fan. The leading edge is stepped down from the hub at predetermined intervals such that the width of the overall fan blade decreases at each step. The present invention includes a leading edge which extends beyond the generally uniform width of a typical fan blade. The steps may be of equal length whereby the first step closest to the hub is the same length as the other steps. Thus, a preferred ratio of the width of the steps of the leading edge in the present invention is approximately 3:2:1. By way of example, the leading edge may be an additional three inches from the width of the body portion in a typical fan blade, the second step is an additional two inches from the width of the body portion of a typical fan blade and the third step is an additional one inch from the width of the body portion of a typical fan blade. The steps provide for increased turbulent airflow. While the steps may be of any proportion, it appears that steps of uniform proportion create the optimal turbulent airflow.

One of the benefits of having a stepped leading edge on the fan blade is that movement of the blade creates greater airflow velocity than the existing fan blade.

Another advantage of the stepped design is that it provides for a more balance airflow and greater coverage area.

Yet another advantage of the present invention is a greater velocity of airflow in the "dead area" below the centerline of the fan. In a typical fan blade design, the area directly under the hub of the fan to a distance of approximately twenty feet from the hub does not receive a significant amount of airflow. This area was known as the "dead area." The stepped configuration of the leading edge of the present invention provides for airflow within the dead spot; that is the fan blade of the present invention has a dead spot of less than three feet.

Additionally, the design of the present invention provides the benefit of extending the effective range of air movement an additional 8-9 feet beyond the range of a fan having standard saw blades. Advantage that with a stepped leading edge, the angle of the blade can be up to 22° whereas typical HVLS fans are between 10° to 15°.

Another invention includes a manifold or diffuser to deliver air to a desired location. The manifold has an inlet and outlet whereby the outlet has one or more louvres. The louvres are adjustable to control the volume of air that is discharged from the manifold. The louvres include a stepped design along one edge of the louvre. The stepped-louvre design provides a more balanced airflow.

Another advantage of the stepped louvre is that it creates greater airflow velocity than existing louvres.

The manifold and stepped-louvre design may be utilized with a conventional fan or may be used with the stepped-fan blade design of the present invention. The benefits of using the manifold having stepped louvres in connection with the stepped-fan blade design are that the stepped louvres may be combined with the stepped-fan blade design to distribute either heated air or chilled air in a turbulent fashion and provide for a more balanced distribution of the air. The benefits of the fan described above will also apply to the air handling manifold having stepped louvres.

Other benefits of the manifold of the present invention may be found in the generally trapezoidal shape of the manifold. The trapezoidal shape provides for improved distribution of air along the top portion of the fan blades such that the cool air from the manifold or diffuser is more evenly distributed by the fan blade. If air is distributed at only one point at the top of the fan blade, as in prior art designs, the fan tends to push the cooled air into one specific area, rather than uniformly distributed the air. The trapezoidal shape manifold or diffuser distributes the air more evenly along the fan blade to permit a relatively even distribution of the air by the fan, rather than having the cooled air pool in one specific area.

The invention further includes an embodiment which has openings in the bottom portion of the manifold positioned above the dead zone of the fan. The openings permit cooled air from the manifold or diffuser to be distributed directly into the dead zone of the fan.

Finally, one of the embodiments of the present invention includes a unique system for controlling the configuration of the louvres such that optimal air flow from the manifold or diffuser may be directed along the top surface of the fan blade.

While some of the advantages of the present invention are set forth above, the full extent of the benefits of the present inventions will be understood in the drawings and detailed description of the preferred embodiments of the invention set forth below.

DESCRIPTION OF THE FIGURES

Other objects and advantages of the invention will become apparent upon reading the following detailed description and upon reference to the following drawings.

DETAILED DESCRIPTION OF THE PREFERRED EMBODIMENTS OF THE INVENTION

A typical high volume, low-speed fan has between four to eight fan blades. The fan blades are typically between 4-feet to 12-feet in length and have a width of 6 inches. Thus, the total diameter of a typical fan is between 8-feet (96 inches) to 24-feet (288 inches).

Figure 1:
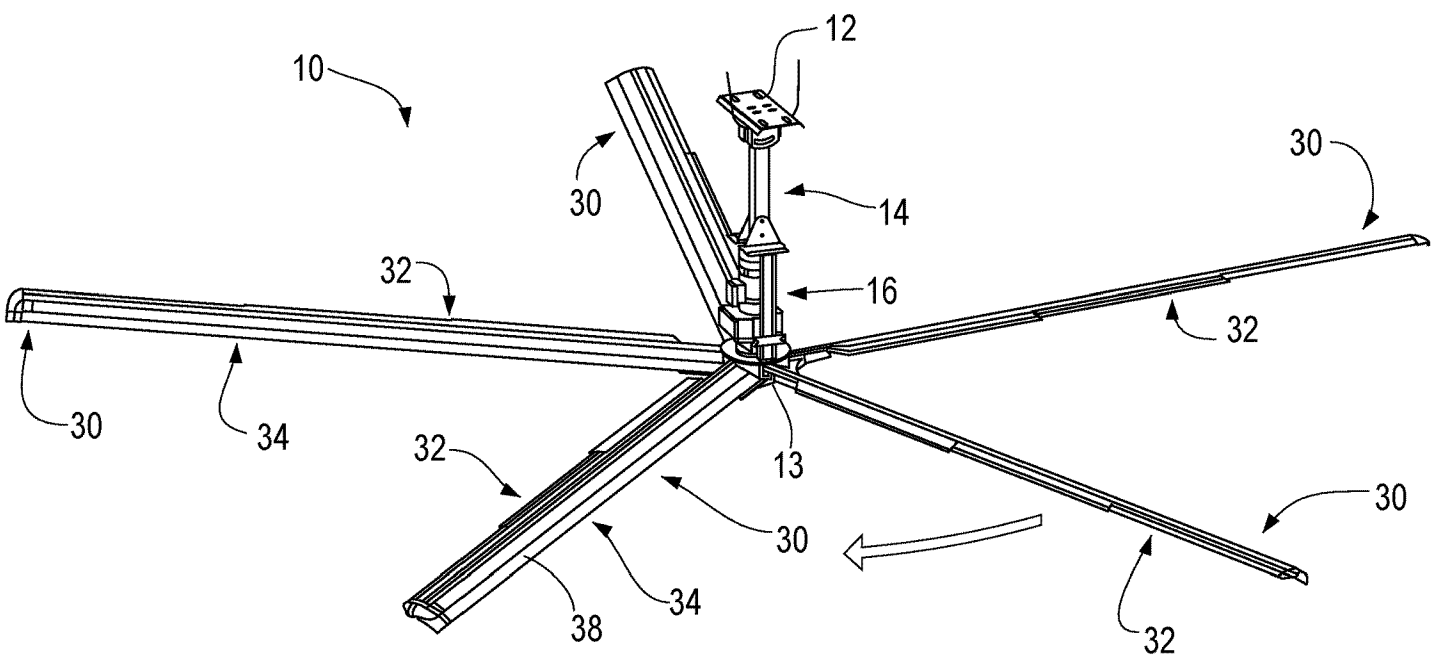
FIG. 1 is a perspective view of the fan of the present invention.
Figure 2A:
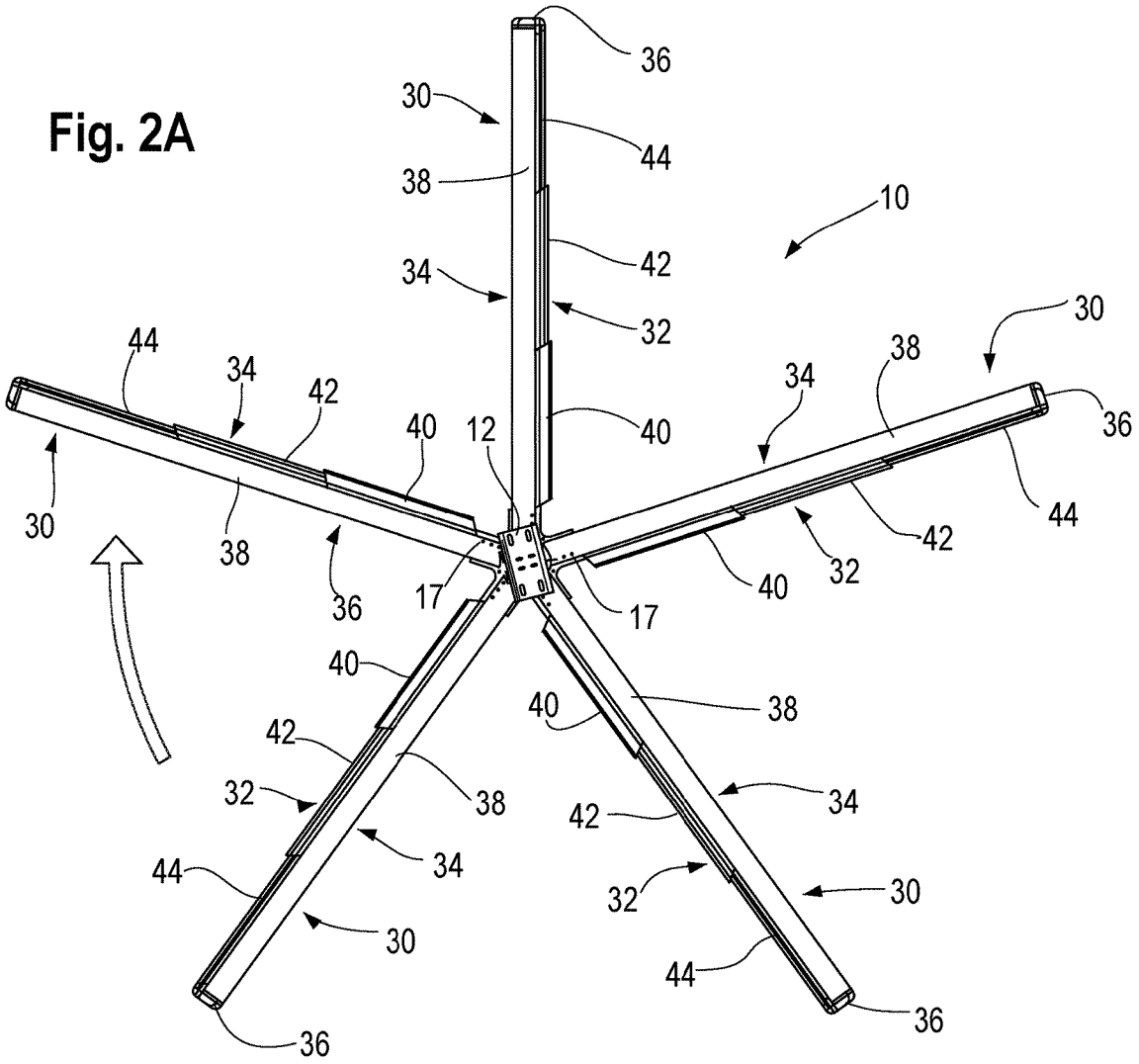
FIG. 2A is a top plan view of the fan.
Figure 2B:
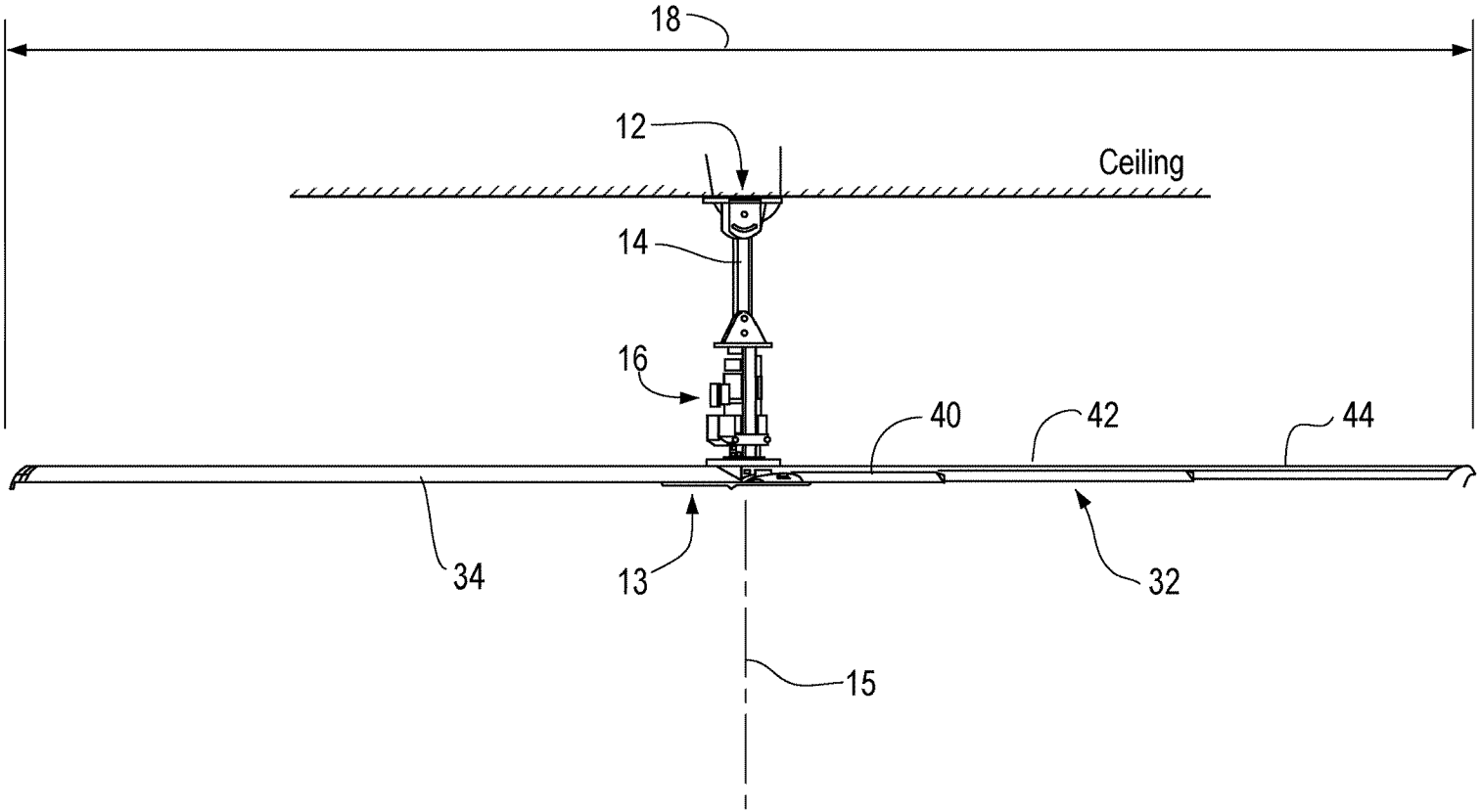
FIG. 2B is a side elevation view of the fan of the present invention showing the step design.

In the preferred embodiment of the present invention, as shown in FIGS. 1, 2A and 2B, the fan 10 is mounted to a ceiling 20. The fan 10 is mounted to the ceiling 20 using a standard mount such as a universal I-Beam clamp with a swivel 12. The fan 10 may include an optional drop extension 14 that is 1 foot, 2 foot, 4 foot or more in length, depending upon the distance from the ceiling to the floor. At the end of the drop extension 14 is a gear motor 16. The motor 16 is typically an electromagnetic motor. The horsepower of the motor varies depending upon the diameter of the entire fan 18. For example, an 8-foot and 12-foot fan typically has a 1 horsepower motor 16. The 16-foot fan typically includes a 1.5 horsepower motor 16, and a 20-foot and 24-foot fan typically has a 2.0 horsepower motor 16. Attached to the motor 16 is a fan blade mount 13 that has a centerline 15 at the center of the fan 10 and motor 16. The fan blade mount 13 connects a fan blade 30 to the motor 16. The fan blade 30 is typically affixed to the fan blade mount 13 by means of a plurality of fasteners such as a bolt, screw, pin, rivet or the like.

Figure 3A:
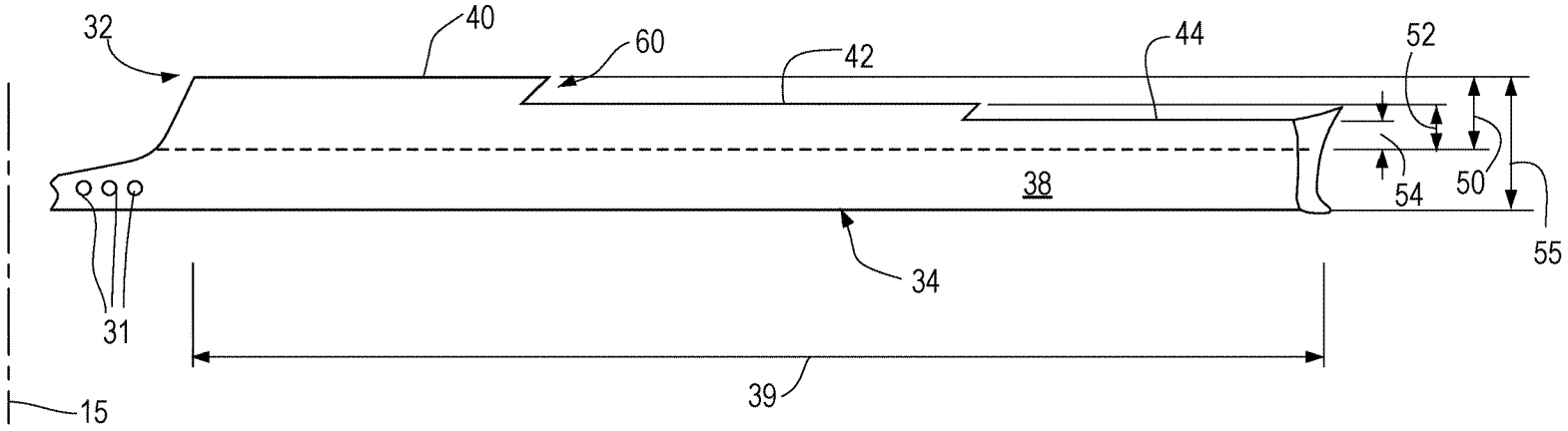
FIG. 3A is a top plan view of a fan blade of the present invention showing the stepped design.

The preferred embodiment shown in FIGS. 1, 2A and 2B includes five fan blades 30, however, there may be a greater number of fan blades, or there may be less than five fan blades. Each fan blade 30 has a leading edge 32, and a trailing edge 34 and an end cap 36. The fan blade 30 includes a blade body 38. The blade body 38 is typically made of an extruded aluminum alloy, but could be made of a composite metal, carbon fiber material, a graphite material, fiberglass, wood or other similar material. The leading edge 32 of the fan blade has steps 40, 42, 44 (as shown in FIGS. 2A and 3A) from the portion of the leading edge 32 fan blade 30 positioned closest to the centerline 15 of the fan blade mount 13.

The stepped configuration of the leading edge 32 of the fan blade is shown in more detail in FIGS. 2A, 2B, 3A, 3B, 4 and 5A. The leading edge 32 of the fan blade 30 has a first step 40, a second step 42 and a third step 44. The steps extend from the blade body 38. The leading edge 32 of the fan blade 30, including the first step 40, the second step 42 and the third step 44, are preferably made of an extruded polymer material, such as high-impact polystyrene, but may be constructed of a composite plastic material, graphite, fiberglass, carbon fiber, aluminum or any material having similar features and properties to the identified materials.

The steps 40, 42 and 44 preferably have generally equal lengths proportional to the length of the blade body 38. Thus, the first step 40 would be approximately ⅓ the total length 39 of the blade body 38. The second step would also be approximately ⅓ the total length 39 of the blade body 38. Likewise, the third step would be approximately ⅓ the total length 39 of the blade body 38. The steps 40, 42 and 44 have a width in a ratio of 3:2:1. Thus, the distance that the first step 40 extends beyond the front edge of the blade body 38 is 3-inches; the distance the second step 42 extends 52 is 2-inches and the third step 44 extends 54 is 1-inch. The ratio of the distance the various steps 40, 42 and 44 extend beyond the front edge of the blade body 38 is 3:2:1. While the preferred embodiment has steps of proportional length and proportional width, it is not a requirement. The important aspect of the step configuration is that the leading edge has multiple steps, from the area of the fan blade 30 closest to the hub. The steps decrease the thickness of the blade in each step that proceeds from the hub.

Figure 3B:
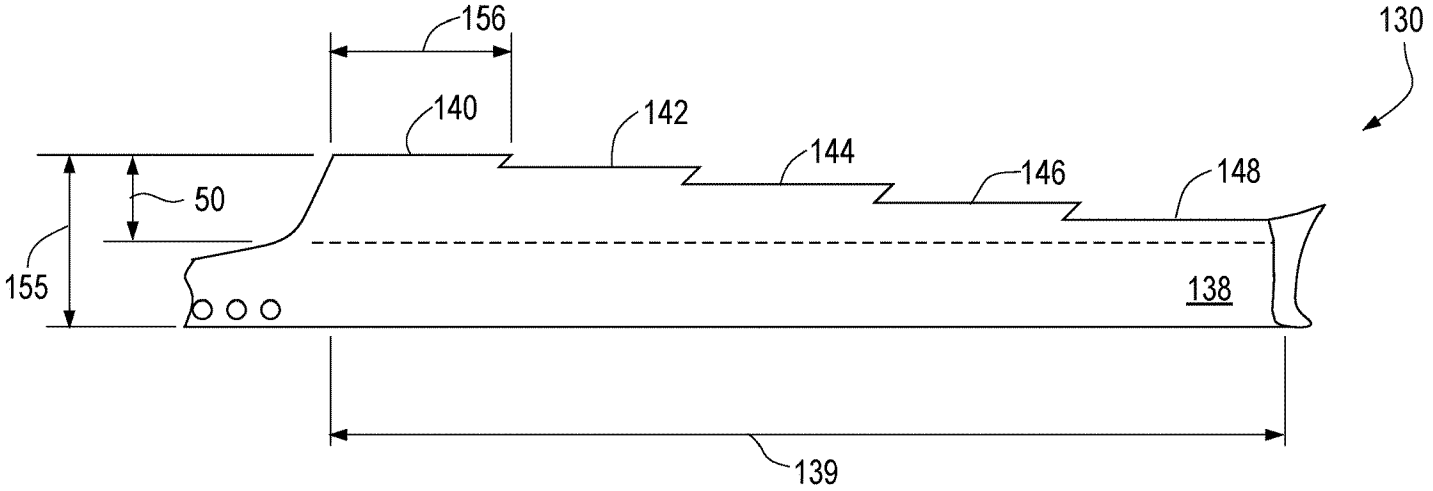
FIG. 3B is a top plan view of an alternative design of the fan blade of the current invention that includes five steps.

While the preferred number of steps is three with a ratio of 3:2:1, the number of steps may be more than three, so long as the ratio of length of the steps corresponds to the number of steps and the distances the various steps extend beyond the front edge of the blade body is a ratio equal to the number of steps. FIG. 3B shows a blade that has five steps. By way of example, a 20-foot diameter fan would have a fan blade 130 of approximately 10-foot in length 139. The ratio of the steps in the preferred embodiment would be 5:4:3:2:1. Each step 140, 142, 144, 146, and 148 would be approximately 2 feet in length 156. The overall fan width 155 should not exceed 9-inches in the preferred embodiment. A fan blade 30 that exceeds a width of 9-inches may cause an undesirable load to be placed on the motor. It is, of course, possible for the distance to be greater than 9-inches if one chooses to construct a fan using a non-conventional fan motor. In the above example of the 5 step fan blade, the distance from the front edge of the fan body 38 to the leading edge of the step 40 should not necessarily exceed 3 inches. In the embodiment of a 5 step fan blade (FIG. 3B), the distance of the first step 50 would be approximately 3-inches. Each step would then decrease by 6/10 of an inch.

Figure 4:
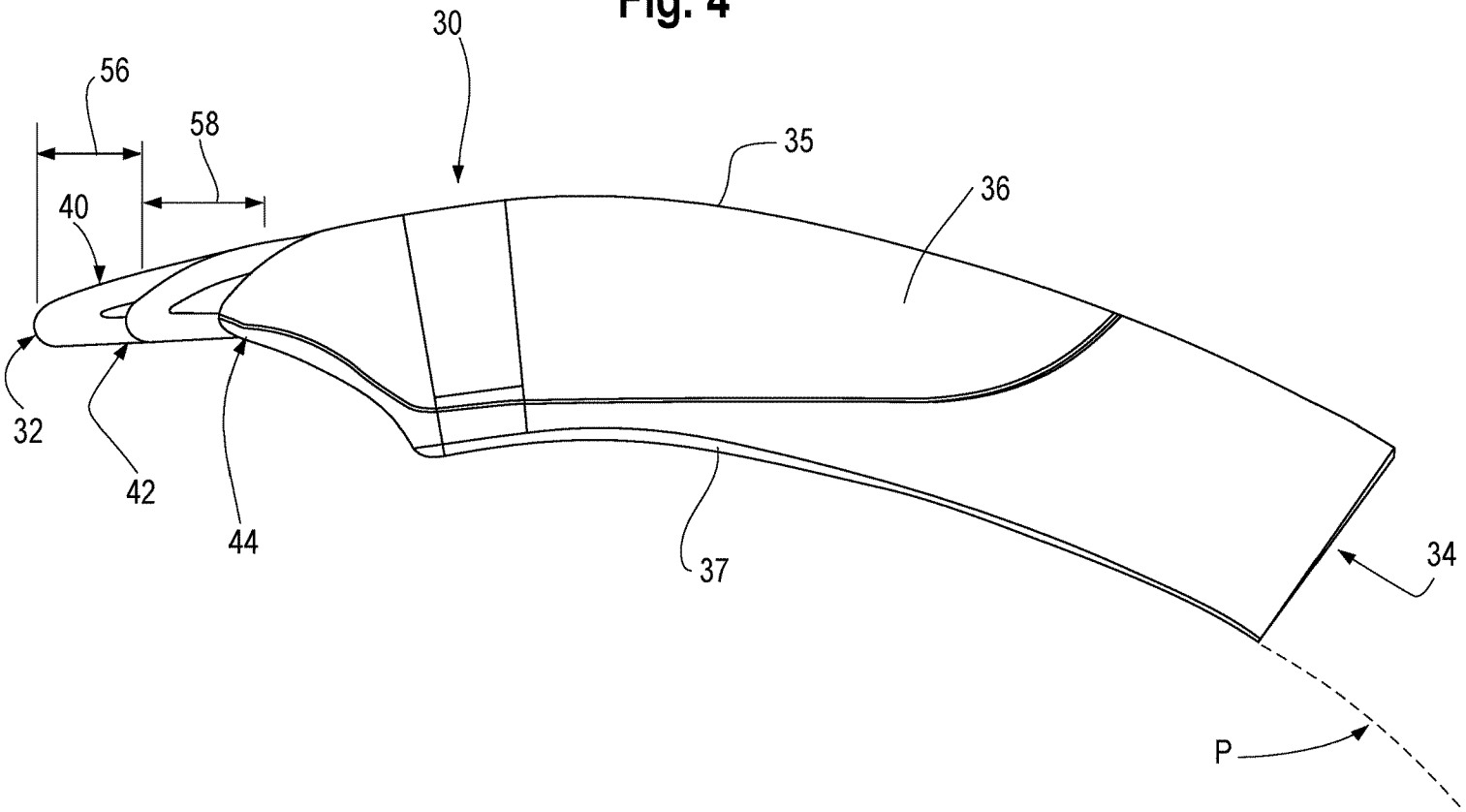
FIG. 4 is a side view of the fan blade of the present invention.

FIG. 4 is a side view of one of the preferred embodiments of the fan blade of the present invention which has 3 steps. The blade 30 includes a leading edge 32. The leading edge 32 includes a series of steps 40, 42 and 44. The distance between the first step 40 and the second step 42 of the leading edge 32 is shown as 56. Likewise, the distance between the second step 42 and the third step 44 is shown as 58. The blade 30 has an upper portion 35 and a lower portion 37. The blade 30 also has a rearward portion 34. The steps 40, 42 and 44 along the leading edge 32 of the blade 30 provides vortex along the edge of the steps 60 and 62. The vortex created at the edges of the steps 60 and 62 create a greater turbulent airflow below the fan. The vortex created at the edges of the steps 60 and 62 also provide for greater airflow velocity in the area near the centerline 15 of the fan.

The pitch P of the blade 30 is approximately 22°. The design of the steps 40, 42 and 44 along the leading edge 32 of the blade 30 permits for the blade to accommodate up to a 22° pitch. Conventional HVLS fans typically have a pitch for the blade between 10°-15°. The stepped design of the leading edge of the fan blade allows for a pitch between 18° to 22° to be implemented without increasing the strain of the motor. The increased pitch promotes more downward airflow.

Figure 5A:
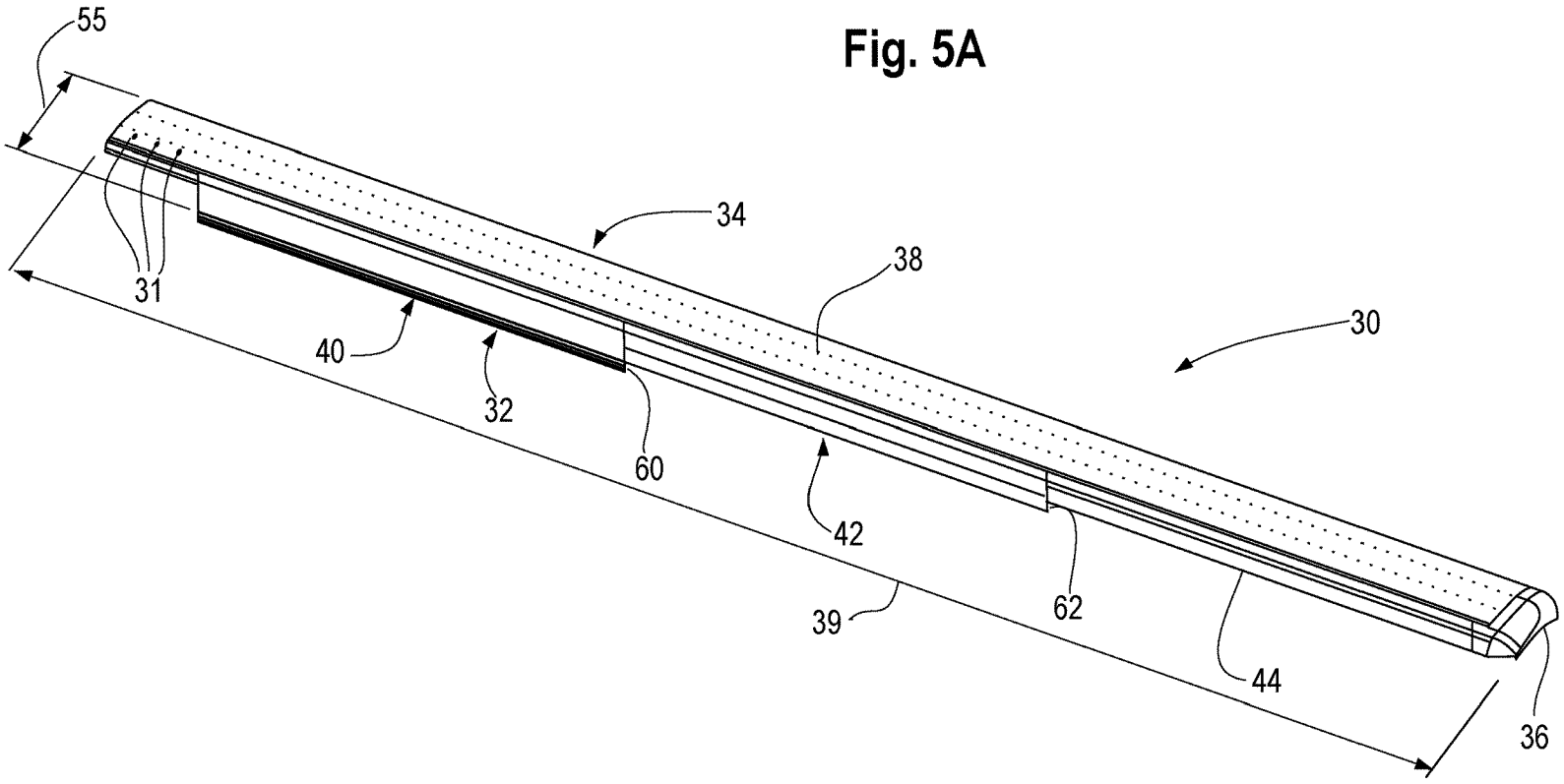
FIG. 5A is a perspective view of a fan blade of the current invention showing three steps.
Figure 5B:
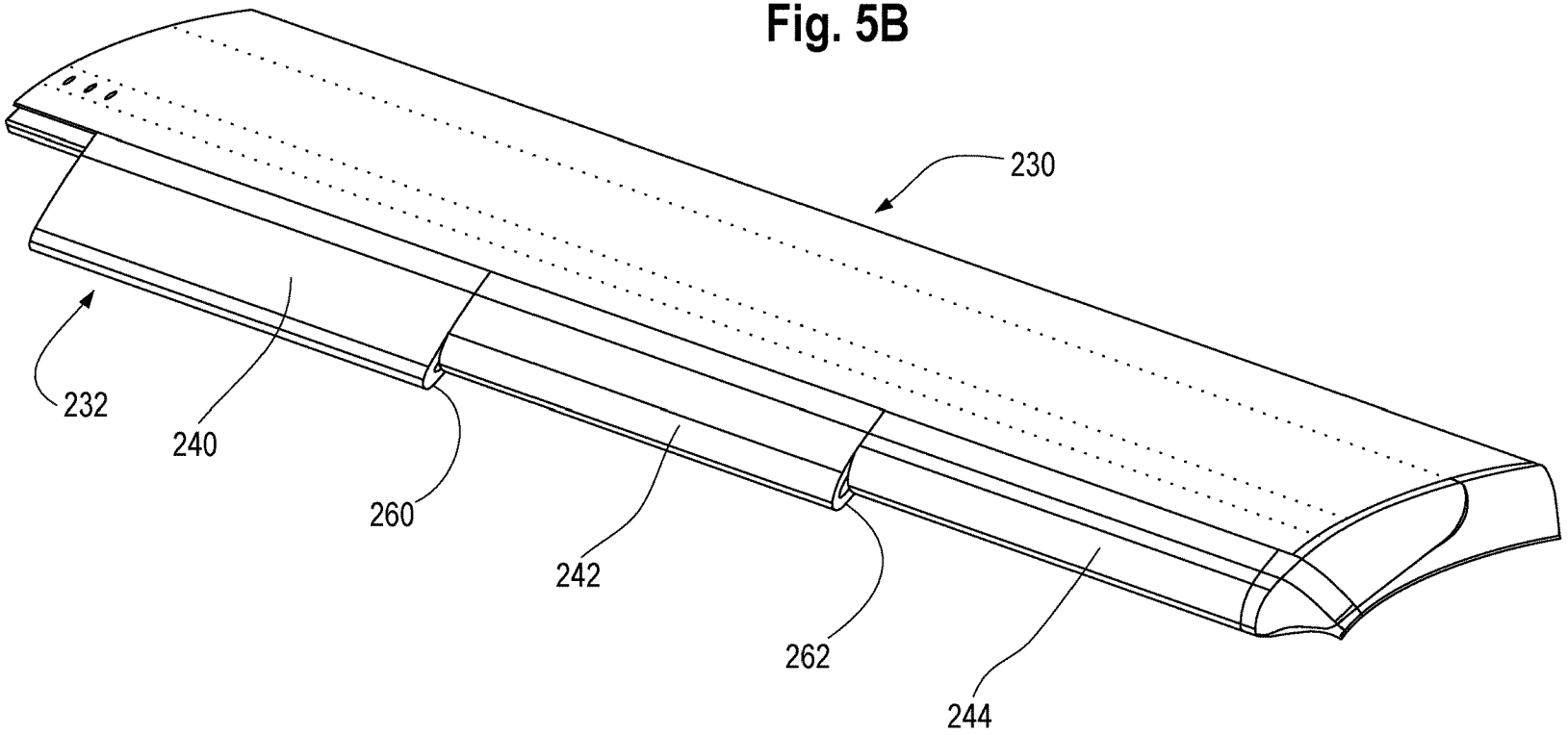
FIG. 5B, is a perspective view of the alternate embodiment of the fan blade of the present invention.

The steps 40, 42 and 44 along the leading edge 32 of the fan blade 30 have edges 60 and 62 respectively. The edges 60 and 62 of the preferred embodiment have a recessed or Z-shaped configuration. This configuration is for aesthetic purposes. As shown in FIG. 5B, the steps 240, 242 and 244 have edges 260 and 262 that are at approximately a 90° angle to the leading edge 232 of the fan blade 230. The configuration of the edges 260 and 262 does not affect the function of the fan blade 230.

An actual embodiment of the preferred invention was tested at a warehouse facility in Beaver Dam, Wisconsin. The height of the facility was twenty-five feet from the floor to the ceiling. The high-velocity, low speed fan was a 24-foot diameter fan that was mounted twenty feet from the floor—in other words, the fan had approximately a five foot drop from the ceiling. The fan had five blades including three steps on each blade as depicted in FIGS. 3A, 3B and 4. The average velocity of the air was measured using a wind velometer gauge. The air velocity was measured at a height of 48-inches above the level of the floor. Measurements were taken at various distances, at approximately three foot intervals, from the centerline 15 of the fan. Measurements were taken at each location using the wind velometer gauge over a time period of approximately thirty seconds. Because the airflow is not constant, the maximum and minimum airflow measurements were recorded over the thirty second period. The maximum and minimum velocity readings over the thirty second period were averaged and are set forth in the chart below:

| Distance from Center of Fan (Feet) | Velocity (Miles Per Hour) |
|---|---|
| 3 | 2.3 |
| 6 | 3.0 |
| 9 | 4.0 |
| 12 | 2.8 |
| 15 | 4.0 |
| 20 | 3.0 |
| 23 | 3.1 |
| 26 | 2.3 |
| 30 | 1.9 |
| 33 | 2.9 |
| 36 | 3.0 |
| 42 | 2.0 |
| 46 | 2.7 |
| 50 | 2.0 |
| 53 | 1.9 |
| 58 | 1.1 |
| 62 | 1.1 |

Figure 6:
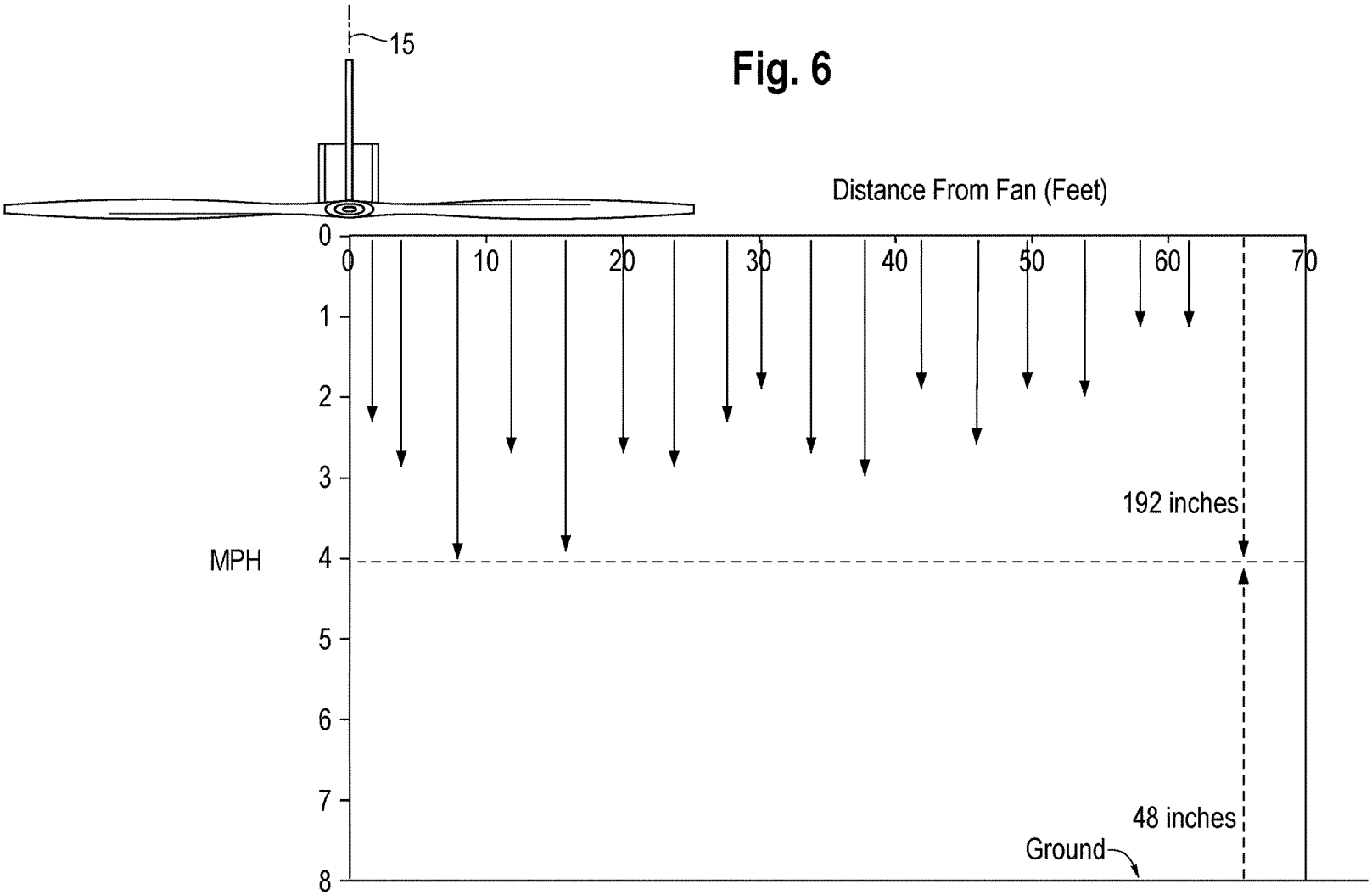
FIG. 6 is graph of air speed versus distance from the center of the fan.

FIG. 6 is a graph of the average velocity in MPH of airflow created by the circulation of the fan 10 utilizing the blades 30 of the preferred embodiment at various distances from the centerline 15 of the fan. As shown in FIG. 6, for example, at approximately 8-feet and 16-feet from the centerline 15 of the fan, the average velocity of airflow 48-inches above the ground was 4 miles per hour. The human body typically feels 6 to 10° F. cooler (Relative Temperature) than the ambient temperature of the air when the air is circulating at 4 miles per hour. At airflow at a velocity of 2 miles per hour, the human body fees 3 to 5° cooler than the ambient temperature of the air. The benefit of the fan design is a greater velocity of air circulation is achieved within close proximity to the centerline 15 of the fan. In addition, the measureable air circulation extends to a distance of 62-feet from the centerline 15 of the fan 10.

This chart shows that the stepped design has significant airflow coverage and overall air dispersion. The fan of the current invention has minimal airflow dead spots, especially within close proximity to the centerline of the fan.

Figure 7:
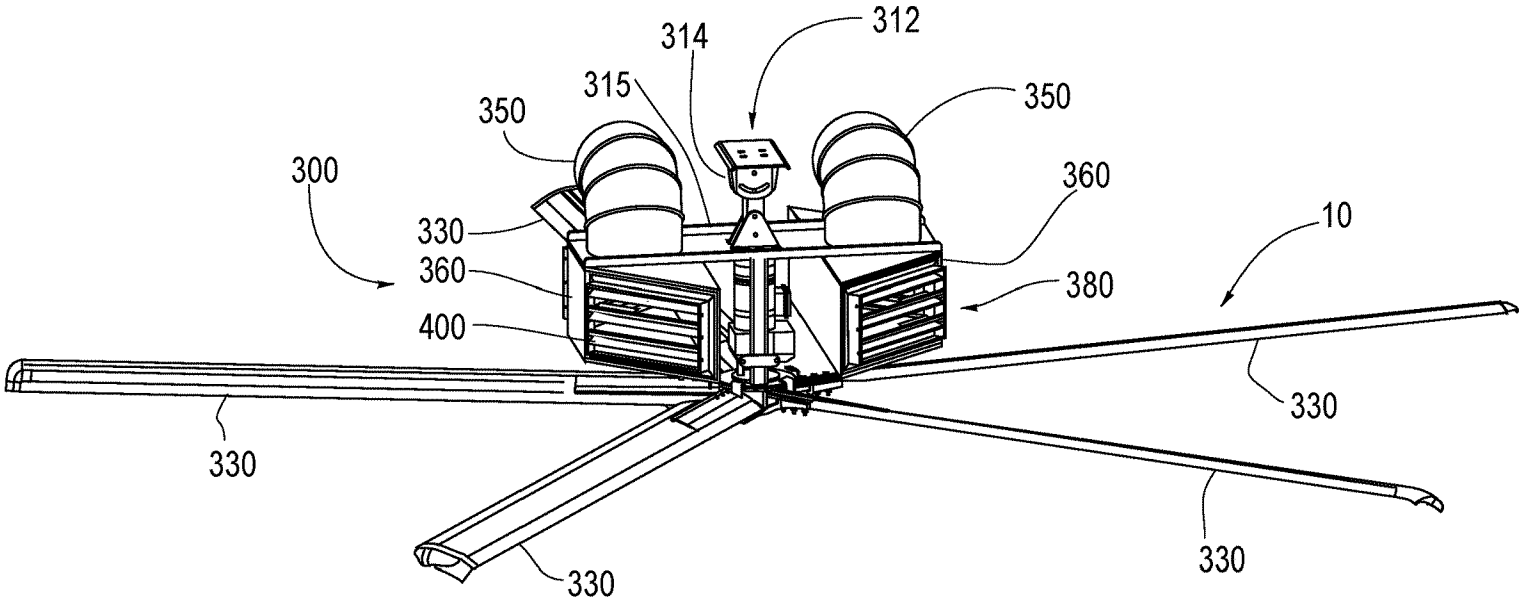
FIG. 7 is a perspective view of the stepped-louvre heating, ventilating and air conditioning unit used in combination with the high volume, low-speed fan.

The air-flow manifold utilizing a stepped-louvre design may be seen in FIG. 7. The stepped-louvre, air-low manifold 300 of FIG. 7 is shown in relation to the stepped fan blades 10 of the present invention. While it is preferred to utilize the stepped-louvre, air-flow manifold 300 in connection with the stepped fan blades 10, the stepped-louvre, air-flow manifold 300 may be used in connection with any design of a high volume, low-speed fan.

In FIG. 7, the stepped-louvre, air-flow manifold 300 is positioned above the fan blades 330 relative to the ceiling. The ceiling mount 312 affixes the fan 10 and stepped-louvre, air-flow manifold 300 to the ceiling (not shown). The ceiling mount 312 is adjustable 314 such that the fan blades 330 are mounted relatively parallel to the floor. The stepped-louvre, air-flow manifold 300 includes a mounting bracket 315 which accommodates the heating, ventilating and air conditioning (HVAC) ducts 350. The HVAC ducts 350 are typically part of a separate HVAC system that may be installed in the space. There is typically a drop of two feet from the ceiling to the fan blades 330 to accommodate the HVAC ducts 350 and stepped-louvre, air-flow manifold 300.

Figure 9:
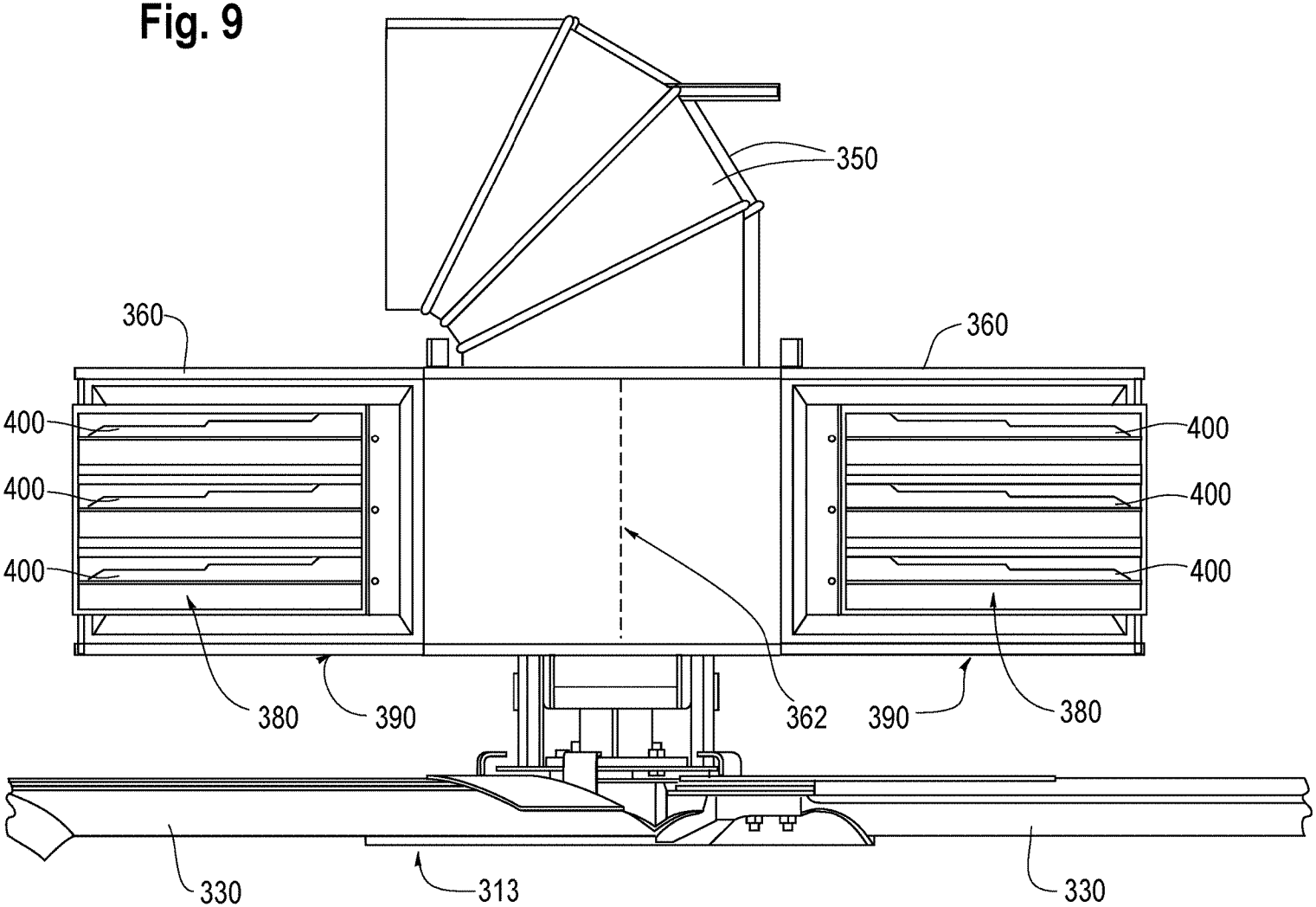
FIG. 9 is a side view of the manifold and the stepped louvres.

The stepped-louvre, air flow manifold 300 typically has a trapezoid shaped diffuser 360 such that air is delivered from the HVAC duct 350 and is equally dispersed through one of the two openings 380 of the diffuser 360. While it is preferred that the diffuser 360 is trapezoid shaped, FIG. 9 depicts the diffuser 360 in any shape or configuration that can disperse the air flow from the HVAC vent 350 in a generally uniform manner along the top of the flan blades 330.

Figure 8:
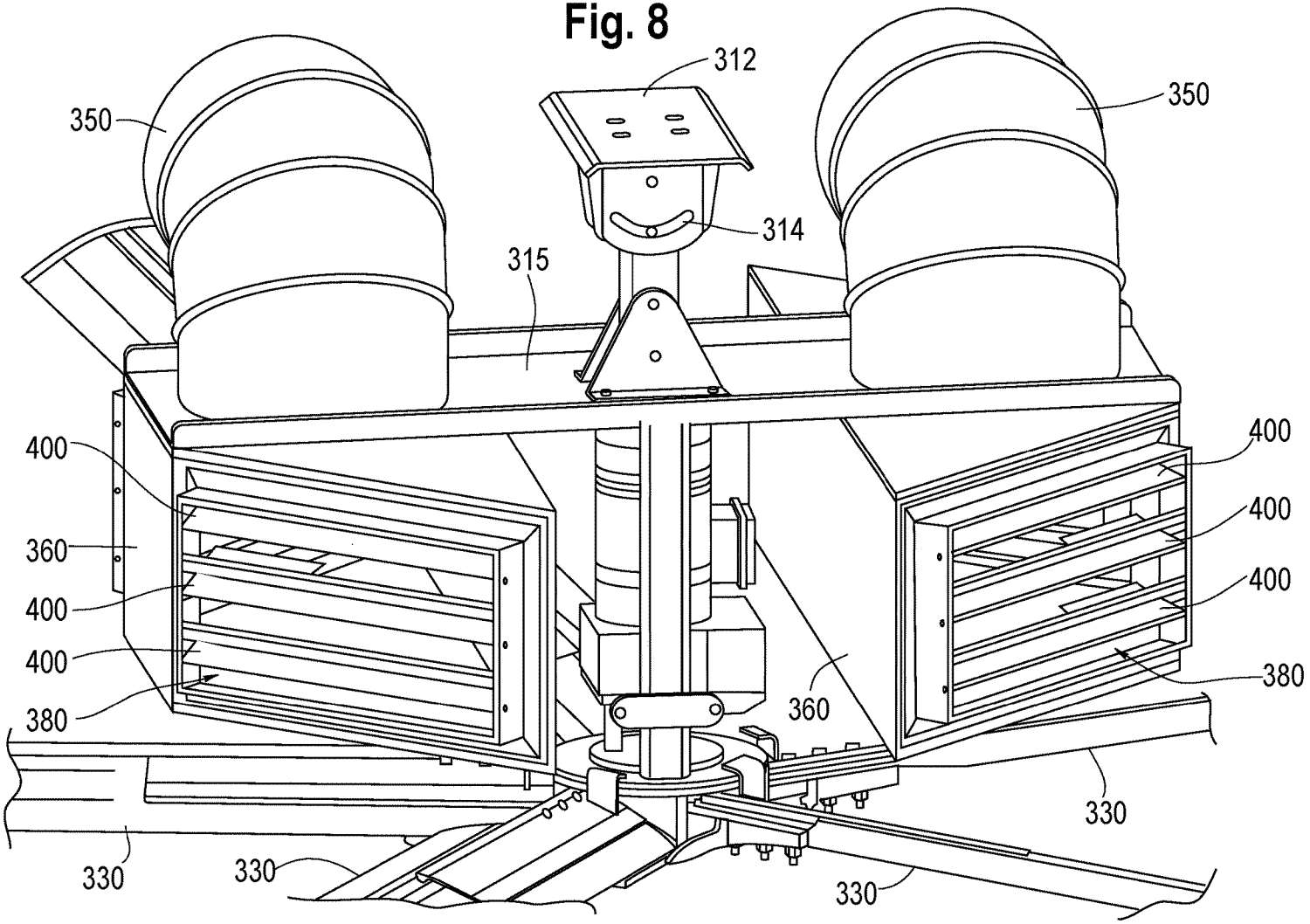
FIG. 8 is a perspective view of the trapezoid-shaped manifold and the stepped louvres.

FIG. 8 shows the trapezoidal-shaped diffuser 360 and one of the two openings 380 of the diffuser 360. Air from the HVAC duct 350 is dispersed from the opening 380 of the diffuser 360 to the top portion of the fan blades 330. The fan blades 330 then distribute the air from the HVAC ducts 350 downward as described above with respect to the fan blades. The trapezoid-shaped diffuser 360 has an opening to accommodate the HVAC duct 350 such that air can flow from the HVAC duct 350 to the diffuser 360.

Figure 10A:
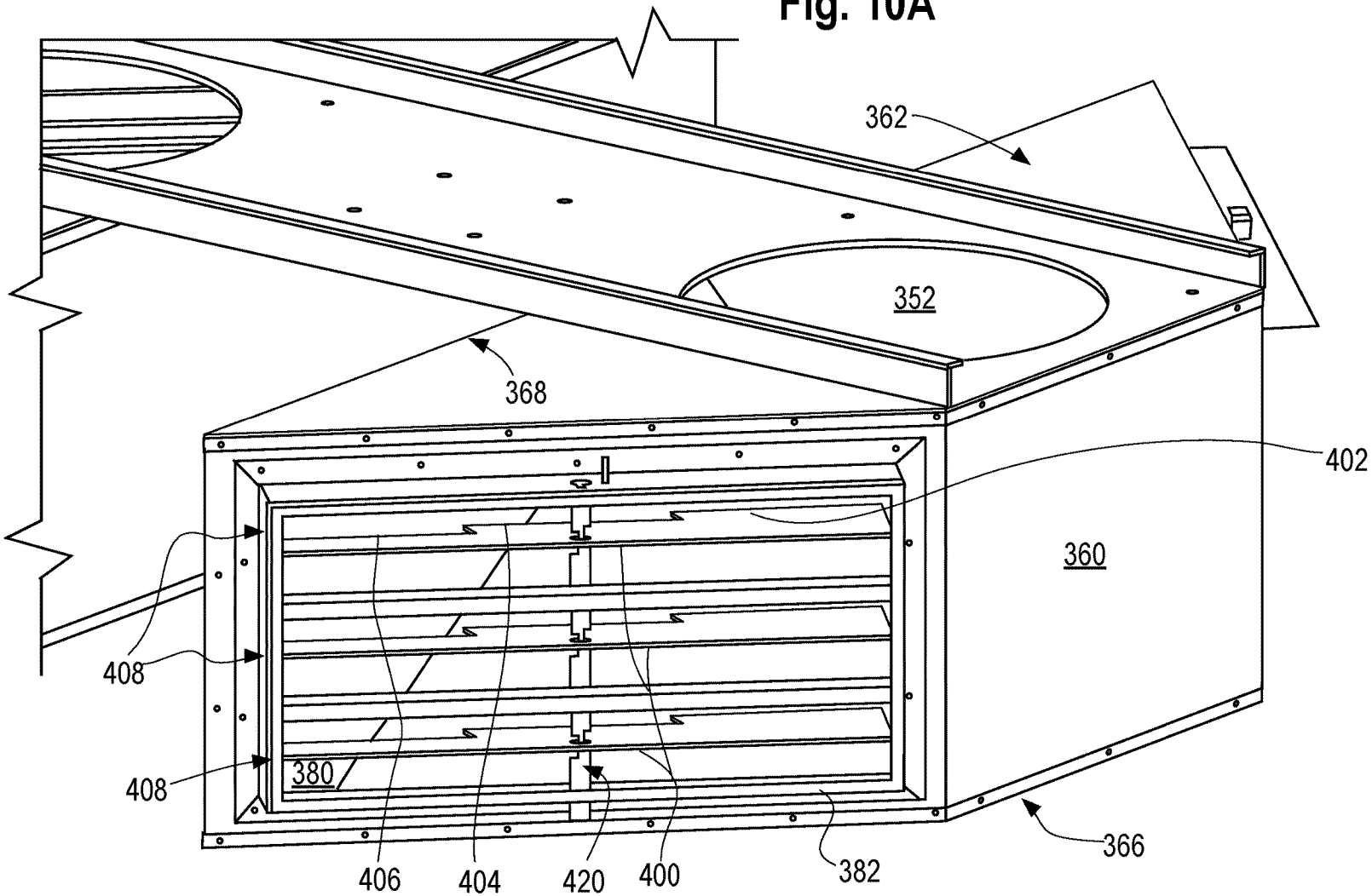
FIG. 10A is a perspective view of the trapezoidal shaped stepped-louvre heating, ventilating and air conditioning unit having the stepped louvres.
Figure 10B:
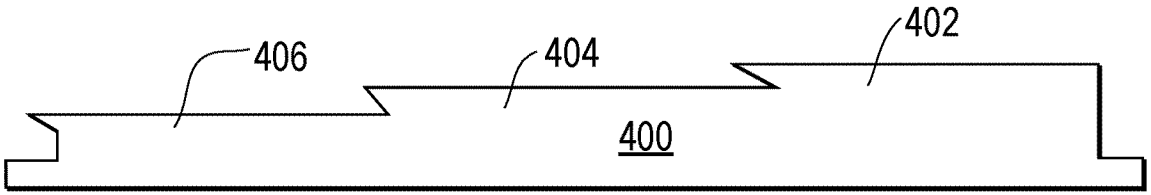
FIG. 10B is a side-elevation view of the stepped-louvres of the present invention.

FIGS. 10A and 10B are a close-up view of the opening 380 of one embodiment of the trapezoidal-shaped diffuser 360. The trapezoidal-shaped diffuser 360 has a top portion 362, a bottom portion 364, a short sidewall 366 and a long sidewall 368. There are two openings 380 in the trapezoidal-shaped diffuser 360. The top portion 362 includes an HVAC opening 352 to accommodate the HVAC duct 350. Air from the HVAC duct 350 flows through the HVAC opening 352 into the body of the diffuser 360 and out the openings 380 of the diffuser 360.

The openings 380 of the diffuser 360 are preferably rectangular in shape, but may be of any desired shape. The opening 380 includes a bracket 382, to which the louvres 400 are rotatably affixed 408. The louvres 400 have a stepped configuration, including a first step 402, a second step 404 and a third step 406 in the preferred embodiment of the first step 402 is the thickest, relative to the second step 404 and the third step 406.

The stepped configuration of the stepped louvre 400 is shown in more detail in FIGS. 10A and 10B. The stepped louvre 400 has a first step 402, a second step 404 and a third step 406. The steps extend from the louvre body 408. The stepped louvre 402, including the first step 402, the second step 404 and the third step 406, are preferably made of an extruded polymer material, such as high-impact polystyrene, but may be constructed of a composite plastic material, graphite, fiberglass, carbon fiber, aluminum or any material having similar features and properties to the identified materials.

The steps 402, 404 and 406 preferably have generally equal lengths proportional to the length of the louvre 400. Thus, the first step 402 would be approximately 1/3 the total length of the louvre 400. The second step would also be approximately 1/3 the total length of the louvre 400. Likewise, the third step would be approximately 1/3 the total length of the louvre 400. The steps 402, 404 and 406 have a width in a ratio of 3:2:1. Thus, the distance that the first step 402 extends beyond the front edge of the louvre 400 is 3-inches; the distance the second step 404 extends 2 inches and the third step 406 extends 1 inch. The ratio of the distance the various steps 402, 404 and 406 extend beyond the front edge of the louvre body 400 is 3:2:1. While the preferred embodiment has steps of proportional length and proportional width; it is not a requirement. The important aspect of the step configuration is that the edge has multiple steps, from the area of the louvre 400. The steps decrease in thickness of the louvre in each step.

While the preferred number of steps is three with a ratio of 3:2:1, the number of steps may be more than three, so long as the ratio of length of the steps corresponds to the number of steps and the distances the various steps extend beyond the front edge of the blade body is a ratio equal to the number of steps.

Figures 11A, 11B, 11C:
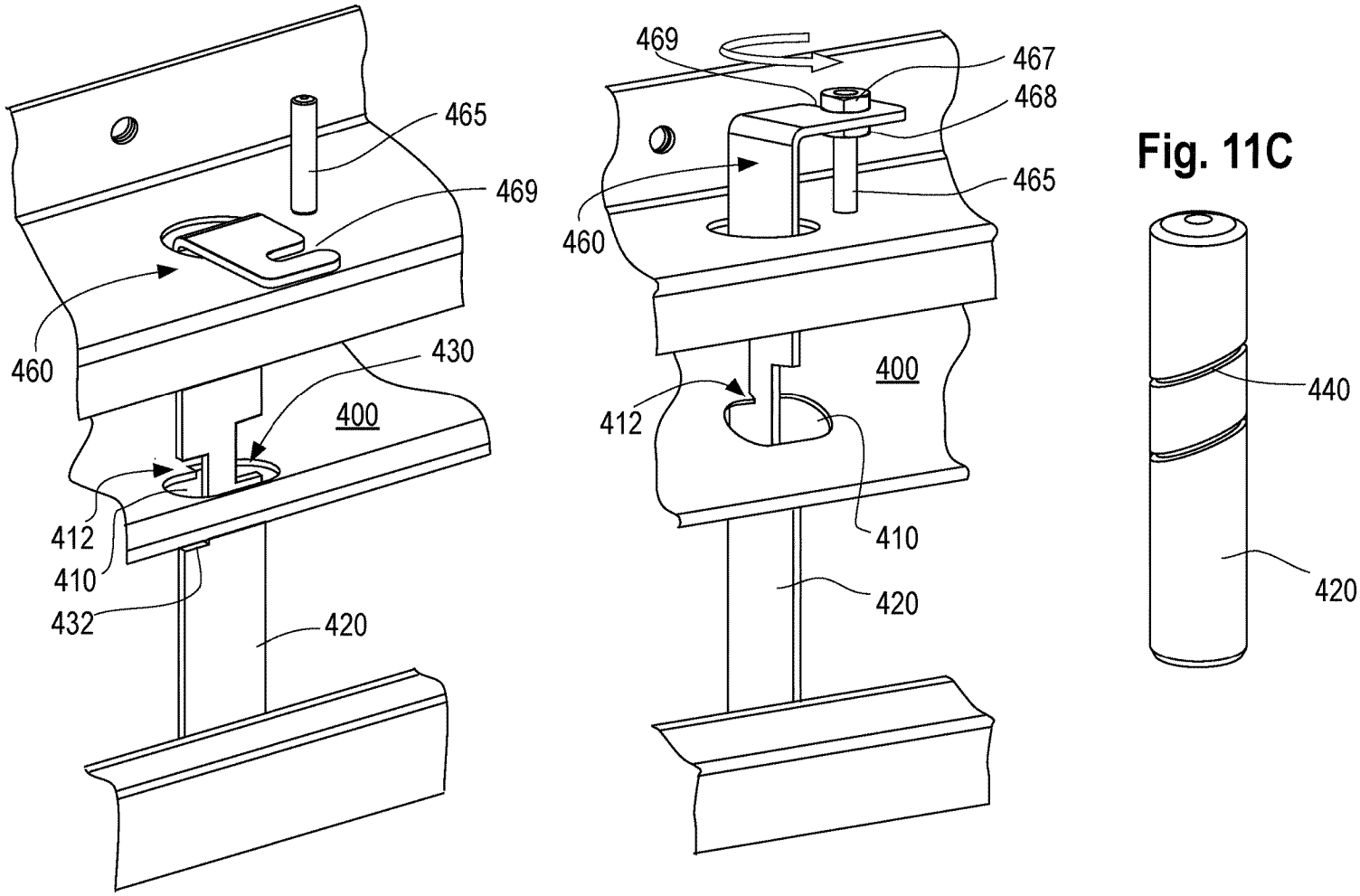
FIGS. 11A, 11B and 11C are perspective views of the various types of control mechanism for the stepped louvres.

As shown in more detail in FIGS. 11A, 11B and 11C, the louvres 400 include an aperture 410 having a lock notch 412. A guide element 420 operates to pivot and control the position of the louvre 400. The guide element 420 engages and disengages with the lock notch 412 of the aperture 410. The guide element 420 includes one or more bushing elements 430 and 432 that engage with the lock notch 412 of the aperture 410. A first bushing element 430 and a second bushing element 432 are located at two separate positions along the guide element 420, such that when the first bushing element 430 engages the lock notch 412, the louvre 400 is pivoted to a first position relative to the opening 380. The louvre 400 is positioned at a first angle relative to the plane formed by the opening 380. The guide element 410 has a second bushing 432 that engages with the lock notch in the aperture 410 of the louvre 400. The second bushing 432 is positioned such that the louvre 400 is positioned at a second angle relative to a plane formed by the opening 380. The guide element 420 could alternatively be a circular rod as shown in FIG. 11B. The circular guide element 420 includes a serpentine groove 440 that engages the locking notch 412 of the louvre 400. Rotation of the circular guide rod 420 causes the louvre 400 to change angles relative to the plane of the opening 380. Alternatively, the serpentine groove 440 could be prepared with a serpentine track (not shown) that would engage the locking notch 412 of the louvre 400 to position the louvre at the desire angle with respect to the plane formed by the opening 380. The guide element 420 includes a positioning member 460 that operates to control the position of the guide element 420 such, in a first position, the first bushing element 430 engages the locking notch 412 of the louvre 400 and, in a second position, the second bushing element 432 engages the locking notch 412 of the louvre 400. In the preferred embodiment, the positioning member 460 is rotated from a first position to a second position to move the guide element form a first position (wherein the first bushing 430 engages the locking notch 412) to a second position (wherein the second bushing 432 engages the locking notch 412).

A positioning member 460 includes a fine adjustment mechanism 465 that transmits a fine adjustment mechanism 465 that transmits a fine adjustment from the guide element 420, such that the first bushing 430 and second bushing 432 may be adjusted up or down to make a relatively small adjustment of the angle of the louvre 400. The preferred embodiment of the fine adjustment mechanism 465 may be a threaded member and a first nut 467 and second 468 nut positioned on the threaded member of the fine adjustment mechanism 465. The threaded member engages a slot 469 or hole in the positioning member 460. The first nut 467 and second nut 468 are positioned on either side of the slot 469 of the positioning member 460. Rotation of the first nut 467 and second nut 468 impart movement of the positioning member 460 which, in turn, imparts movement of the guide element 420 to the desired louvre position 400. Once in place, the louvre 400 may be locked in place by locking the positioning member 460.

FIGS. 8 and 9 show the stepped-louvres 400 of the current invention. There are three louvres 400 shown for each opening 380 in the preferred embodiment, however, there may be more or less louvres 400 based on airflow and design criteria. The louvres 400 have a stepped design such that the relative thickness of the louvre 400 has three general thicknesses, i.e., it is stepped down from the central portion of the trapezoid 362 from which the HVAC duct 350 is connected to the diffuser 360. The preferred embodiment includes a first step 410 that has a greater dimension in width than the second step 420 or the third step 430. The width of the second step 420 is, likewise, greater than the width of the third step 430. The first step 410, the second step 420 and the third step 430 are proportional, in that the distance between the first step 410 and second step 420 is the same as the distance between the second step 420 and the third step 430. Alternatively, the diffuser 360 may have a perforation 390 in the lower portion to permit a portion of the air to flow directly downward from the diffuser 360 onto the flan blade 330 generally in the area of the fan blade mount 313.

Figure 12:
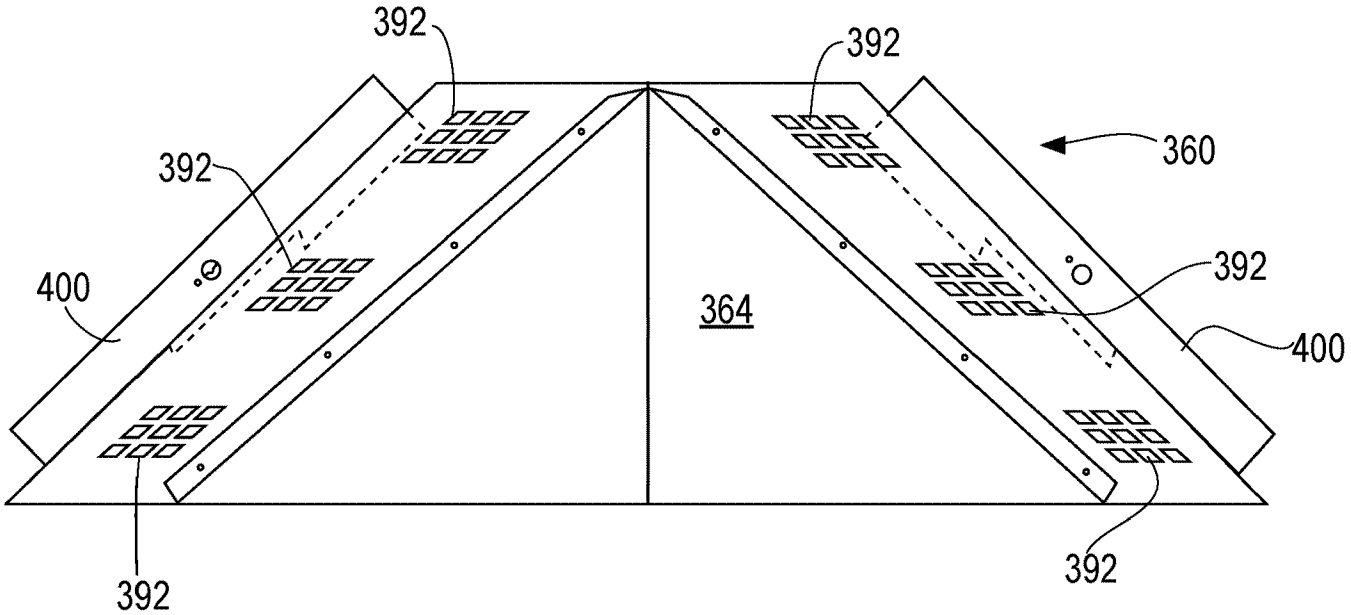
FIG. 12 is a bottom view of the bottom portion of the trapezoidal shaped diffuser depicting the openings.

FIG. 12 depicts a bottom view 364 of the trapezoidal-shaped diffuser 360. The bottom side 364 of the trapezoidal-shaped diffuser 360 includes one or more dead-spot openings 392. The dead-spot openings 392 permit air delivered from the HVAC system to be distributed directly onto the top of the fan blade in an area commonly referred to as the dead-spot. FIG. 9 shows the area of the dead-spot openings 392 or perforations 390 that deliver the air to the top portion of the fan blade 330. The perforations 390 may be of any configuration, however, in the preferred embodiment shown in FIG. 12, the dead-spot openings 392 are configured in a 3×3 grid of square cut-outs. Each cut-out measures approximately 1 inch×1 inch. Air flow from the dead spot openings is directed downward toward the fan blade.

Air exits the opening 380 of the diffuser 360 and is directed by the louvres 400. The louvres 400 may be adjustable to direct the airflow from the opening 380 along the fan blades 330. The louvres 400 further create a turbulent airflow over the fan blades 330 which causes a greater dispersion of the air. Based upon applicant's understanding of the design, it is estimated that the airflow can be detected up to 75 feet from the center line of the fan 10.

Figure 13:
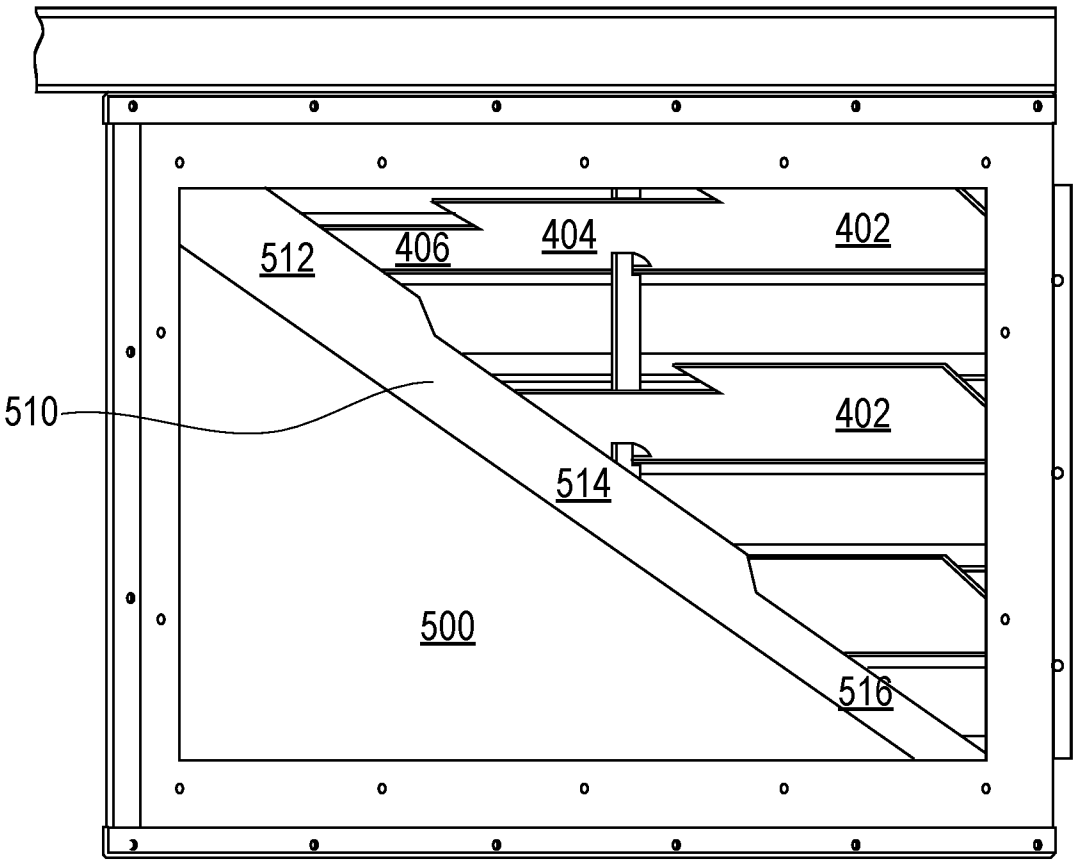
FIG. 13 is a side elevation view of a restrictor plate in the outlet of the trapezoidal shaped diffuser.

FIG. 13, depicts a restrictor plate 500 that may be installed in the opening 380 of the diffuser 360. The restrictor plate controls the volume of air that flows out of the opening 380 of the HVAC diffuser 360. The restrictor plate 500 includes a stepped-edge 510. The stepped-edge 510 has a first step 512, a second step 514 and a third step 516 as described in this application. The stepped-edge 510 of the restrictor plate assists in creating turbulent air flow through the louvres 400, which also have a stepped configuration, having a first step 402, a second step 404 and a third step 406.

The fundamental operating principals and indeed many of the engineering criteria of fan blades for high volume low-speed ceiling fans is similar to fan blades used in basically all forms of compressors, fans and turbine generators. In other words, the rotor blades can be used in a huge range of products such as for example, for helicopter blades, car fans, air conditioning units, water turbines, thermal and nuclear steam turbines, rotary fans, rotary and turbine pumps, and other similar applications.

Although embodiments of the present invention have been described, those of skill in the art will appreciate that variations and modifications may be made without departing from the spirit and scope thereof as defined by the appended claims.

What is claimed is:

1. A high volume, low-speed fan and heating, ventilating and air condition manifold comprising:

a ceiling mount;

an electromagnetic motor coupled to said ceiling mount;

a fan blade mount coupled to an electromagnetic motor;

a plurality of fan blades wherein each of the plurality of fan blades has a length and a width, the plurality of fan blade are coupled to the fan blade mount;

each of the plurality of fan blades includes a body portion, a top portion, a leading edge portion and a trailing portion; the leading edge portion having a length running along the leading edge portion of each of the plurality of fan blades; wherein the leading edge portion of the plurality of fan blades are configured to include a plurality of steps extending along the length of the leading edge portion of each of the plurality of fan blades;

a diffuser to accommodate airflow from an heating, ventilating and air condition system, wherein the diffuser is positioned between the ceiling mount and the plurality of fan blades; said diffuser having an opening location between the fan blades and the ceiling mount;

a plurality of louvres positioned at an angle within a plan formed by the opening of the diffuser, wherein the plurality of louvres are configured to include a plurality of steps extending along an edge portion of each of the plurality of louvres; and an adjustment guide element having a plurality of lock notches wherein each of the plurality of lock notches engage one of the plurality of louvres, wherein a movement of the adjustment guide element operates to move the plurality of lock notches thereby adjusting the angle of the plurality of louvres relating to the plane formed by the opening of the diffuser.

2. The high volume, low-speed fan and heating, ventilating and air condition manifold of claim 1, wherein the adjustment guide element further comprises a positioning member for adjusting the position of the guide element.

3. The high volume, low-speed fan heating, ventilating and air condition manifold of claim 2, wherein the adjustment guide element further comprising a fine adjustment mechanism.

4. The high volume, low-speed fan heating, ventilating and air condition manifold of claim 2, wherein each of the plurality of lock notches comprise an adjustment guide aperture having a notch and the adjustment guide element comprising a bushing wherein the bushing engage with the notch to establish a plurality of angular positions of the plurality of louvres relative to the plane defined by the opening of the diffuser.

* * * * *